US010559212B1

(12) United States Patent
Langer et al.

(10) Patent No.: US 10,559,212 B1
(45) Date of Patent: Feb. 11, 2020

(54) SYSTEMS AND METHODS FOR ACTIONABLE AVIONICS EVENT-BASED COMMUNICATIONS

(71) Applicant: Rockwell Collins, Inc., Cedar Rapids, IA (US)

(72) Inventors: Jason L. Langer, Cedar Rapids, IA (US); Mark A. Jannusch, Cedar Rapids, IA (US)

(73) Assignee: ROCKWELL COLLINS, INC., Cedar Rapids, IA (US)

( * ) Notice: Subject to any disclaimer, the term of this patent is extended or adjusted under 35 U.S.C. 154(b) by 123 days.

(21) Appl. No.: 15/665,081

(22) Filed: Jul. 31, 2017

(51) Int. Cl.
*G08G 5/00* (2006.01)

(52) U.S. Cl.
CPC ..... *G08G 5/0008* (2013.01); *G08G 5/0021* (2013.01); *G08G 5/0034* (2013.01)

(58) Field of Classification Search
CPC ... G08G 5/0008; G08G 5/0021; G08G 5/0034
See application file for complete search history.

(56) References Cited

U.S. PATENT DOCUMENTS 6,133,867 A * 10/2000 Eberwine ..... G01S 5/0072 342/125
8,862,287 B1 * 10/2014 Clark ..... G01C 23/00 701/3
9,646,502 B1 * 5/2017 Gentry ..... G08G 5/0039
10,019,905 B1 * 7/2018 Kneuper ..... G08G 5/0013
2003/0093187 A1 * 5/2003 Walker ..... B64C 13/20 701/1
2005/0055143 A1 * 3/2005 Doane ..... B64C 13/18 701/301
2009/0088972 A1 * 4/2009 Bushnell ..... G01C 23/005 701/414
2009/0125222 A1 * 5/2009 McCullough ..... G01C 23/00 701/120
2010/0332122 A1 * 12/2010 Weichbrod ..... G01C 23/005 701/533
2013/0046422 A1 * 2/2013 Cabos ..... G08G 5/0034 701/3
2016/0012733 A1 * 1/2016 Girardeau ..... G08G 5/0039 701/529
2016/0189549 A1 * 6/2016 Marcus ..... G08G 5/0034 701/3
2018/0033318 A1 * 2/2018 Yeh ..... G08G 5/0008

* cited by examiner

*Primary Examiner* — Calvin Cheung
(74) *Attorney, Agent, or Firm* — Donna P. Suchy; Daniel M. Barbieri

(57) ABSTRACT

A system includes a flight plan database and a flight plan engine. The flight plan database is configured to store a local flight plan. The local flight plan includes one or more flight actions associated with a plan event condition including at least one of a time, a waypoint, or a position. The flight plan engine is configured to, while a platform is in an operational state, compare the plan event condition of at least one flight action to a current event condition to determine an action state of the at least one flight action, generate a group flight plan including the at least one action based on the action state, and transmit the group flight plan to one or more remote platforms.

14 Claims, 4 Drawing Sheets

SYSTEMS AND METHODS FOR ACTIONABLE AVIONICS EVENT-BASED COMMUNICATIONS

BACKGROUND

The present disclosure generally relates to avionics communications between airborne platforms. More particularly, the present disclosure relates to systems and methods for actionable avionics event-based communications.

In existing aircraft and other platforms, a flight plan is loaded onto an onboard computer. The flight plan can be used with a flight display to provide situational awareness. The flight plan may include waypoints, tasks, missions, or other actions items to be performed. However, the situational awareness provided by the flight plan is limited to action items for the individual aircraft. For example, existing systems can only display a local flight plan, and are unaware of whether action items are being successfully performed by remote platforms.

Action items cannot be easily transferred or shared between different aircraft. Manual communications, such as vocal communications, are typically needed if flight plans change and a new or additional mission waypoint is assigned or needs to be reassigned. For example, in the event that one flight member of a team is unable to complete a flight plan action item, the coordination and reassigning of that portion of the flight plan and mission requires many manual steps and vocal communications and coordination, which can be cumbersome and error prone.

SUMMARY

In one aspect, the inventive concepts disclosed herein are directed to a system. The system includes a flight plan database and a flight plan engine. The flight plan database is configured to store a local flight plan. The local flight plan includes one or more flight actions associated with a plan event condition including at least one of a time, a waypoint, or a position. The flight plan engine is configured to, while a platform is in an operational state, compare the plan event condition of at least one flight action to a current event condition to determine an action state of the at least one flight action, generate a group flight plan including the at least one action based on the action state, and transmit the group flight plan to one or more remote platforms.

In a further aspect, the inventive concepts disclosed herein are directed to a method. The method includes loading a local flight plan including one or more flight actions associated with a plan event condition including at least one of a time, a waypoint, or a position. The method includes, while an airborne platform is in flight, comparing the plan event condition of at least one flight action to a current event condition to determine an action state of the at least one flight action. The method includes generating a group flight plan including the at least one flight action based on the action state. The method includes transmitting the group flight plan to one or more remote platforms.

In a further aspect, the inventive concepts disclosed herein are directed to an aircraft communication network. The aircraft communication network includes a first processing circuit executing on a first airborne platform and a second processing circuit executing on a second airborne platform. The first processing circuit includes a flight plan database and a first flight plan engine. The flight plan database is configured to store a local flight plan including one or more flight actions. The first flight plan engine is configured to, while the first airborne platform is in an operational state, determine an action state of at least one flight action of the one or more flight actions. The first flight plan engine is configured to generate a group flight plan including the at least one action based on the action state. The first flight plan engine is configured to transmit the group flight plan to a second airborne platform. The second processing circuit includes a second flight plan engine configured to receive the group flight plan from the first processing circuit of the first airborne platform, identify one or more remote flight actions of the group flight plan, determine whether the one or more remote flight actions satisfy an acceptance criteria, and cause a flight display of the second airborne platform to update a displayed image to include the one or more remote flight actions in response to determining that the one or more remote flight actions satisfy the acceptance criteria.

DETAILED DESCRIPTION

Figure 1:
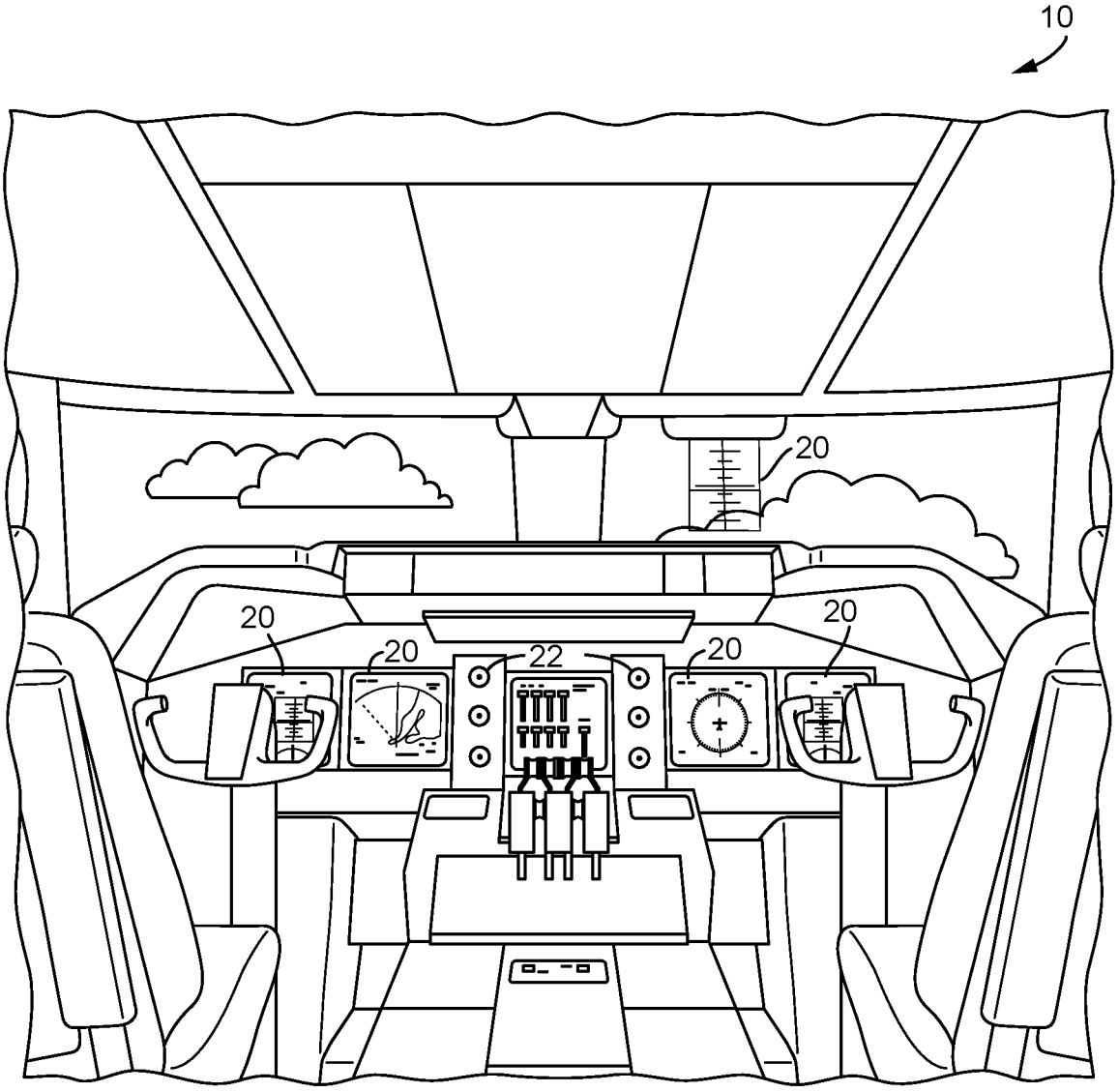
FIG. 1 is a schematic illustration of an exemplary embodiment of an aircraft control center according to the inventive concepts disclosed herein.

Before explaining at least one embodiment of the inventive concepts disclosed herein in detail, it is to be understood that the inventive concepts are not limited in their application to the details of construction and the arrangement of the components or steps or methodologies set forth in the following description or illustrated in the drawings. In the following detailed description of embodiments of the instant inventive concepts, numerous specific details are set forth in order to provide a more thorough understanding of the inventive concepts. However, it will be apparent to one of ordinary skill in the art having the benefit of the instant disclosure that the inventive concepts disclosed herein may be practiced without these specific details. In other instances, well-known features may not be described in detail to avoid unnecessarily complicating the instant disclosure. The inventive concepts disclosed herein are capable of other embodiments or of being practiced or carried out in various ways. Also, it is to be understood that the phraseology and terminology employed herein is for the purpose of description and should not be regarded as limiting.

As used herein a letter following a reference numeral is intended to reference an embodiment of the feature or element that may be similar, but not necessarily identical, to a previously described element or feature bearing the same reference numeral (e.g., 1, 1*a*, 1*b*). Such shorthand notations are used for purposes of convenience only, and should not be construed to limit the inventive concepts disclosed herein in any way unless expressly stated to the contrary.

Further, unless expressly stated to the contrary, "or" refers to an inclusive or and not to an exclusive or. For example, a condition A or B is satisfied by any one of the following:

A is true (or present) and B is false (or not present), A is false (or not present) and B is true (or present), or both A and B are true (or present).

In addition, use of the "a" or "an" are employed to describe elements and components of embodiments of the instant inventive concepts. This is done merely for convenience and to give a general sense of the inventive concepts, and "a" and "an" are intended to include one or at least one and the singular also includes the plural unless it is obvious that it is meant otherwise.

Finally, as used herein any reference to "one embodiment" or "some embodiments" means that a particular element, feature, structure, or characteristic described in connection with the embodiment is included in at least one embodiment of the inventive concepts disclosed herein. The appearances of the phrase "in some embodiments" in various places in the specification are not necessarily all referring to the same embodiment, and embodiments of the inventive concepts disclosed may include one or more of the features expressly described or inherently present herein, or any combination or sub-combination of two or more such features, along with any other features which may not necessarily be expressly described or inherently present in the instant disclosure.

Broadly, embodiments of the inventive concepts disclosed herein are directed to systems and methods for actionable avionics events, such as for sharing and updating flight plans including platform actions in real time. The inventive concepts disclosed herein can be utilized in a number of flight plan control and display systems for various types of electronic avionics applications for airborne platforms (e.g., fixed wing aircraft, rotary wing aircraft), including but not limited to flight control and autopilot systems, navigation systems, flight display systems, communications systems, and radar systems. While the present disclosure describes systems and methods implementable for an airborne platform, the inventive concepts disclosed herein may be used in any type of environment (e.g., in another aircraft, a spacecraft, an autonomous vehicle, a ground-based vehicle, a water-based or underwater vehicle, a subsurface or subterranean vehicle, a satellite, an aeronautical platform, or in a non-vehicle application such as a stationary communications, sensing, or testing system, a ground-based display system, an air traffic control system, a radar system, a virtual display system).

In some embodiments, a system includes a flight plan database and a flight plan engine. The flight plan database is configured to store a local flight plan. The local flight plan includes one or more flight actions associated with a plan event condition including at least one of a time, a waypoint, or a position. The flight plan engine is configured to, while a platform is in an operational state, compare the plan event condition of at least one flight action to a current event condition to determine an action state of the at least one flight action, generate a group flight plan including the at least one action based on the action state, and transmit the group flight plan to one or more remote platforms.

The system can be integrated with an airborne platform or other platform as described herein. For example, the feedback and display devices described herein can be associated with an aircraft cockpit display of the airborne platform.

Systems manufactured in accordance with the inventive concepts disclosed herein can improve operation of avionics systems by enabling real-time sharing, updating, and actionable modification of electronic flight plans across a plurality of platforms. Various such systems can improve situational awareness for pilots or other operators of the platforms by enabling real-time displaying of the actions in flight plans of remote platforms, including whether such actions have been completed, are not yet completed, are incomplete, or cannot be completed, reducing the amount of information operators need to keep in mind to effectively control operation of platforms. Systems manufactured in accordance with the inventive concepts disclosed herein can also improve operation of heterogeneous platform communication networks by enabling real-time sharing of flight plans using existing communication links.

Referring to FIG. 1, a perspective view schematic illustration of an aircraft control center or cockpit 10 is shown accordingly to an exemplary embodiment of the inventive concepts disclosed herein. The aircraft control center 10 can be configured for an aircraft operator or other user to interact with avionics systems of an airborne platform. The aircraft control center 10 may include one or more flight displays 20 and one or more user interface ("UP") elements 22. The flight displays 20 may be implemented using any of a variety of display technologies, including CRT, LCD, organic LED, dot matrix display, and others. The flight displays 20 may be navigation (NAV) displays, primary flight displays, electronic flight bag displays, tablets such as iPad® computers manufactured by Apple, Inc. or tablet computers, synthetic vision system displays, HUDs with or without a projector, head up guidance systems, wearable displays, watches, Google Glass® or other HWD systems. The flight displays 20 may be used to provide information to the flight crew, thereby increasing visual range and enhancing decision-making abilities. One or more of the flight displays 20 may be configured to function as, for example, a primary flight display (PFD) used to display altitude, airspeed, vertical speed, and navigation and traffic collision avoidance system (TCAS) advisories. One or more of the flight displays 20 may also be configured to function as, for example, a multi-function display used to display navigation maps, weather radar, electronic charts, TCAS traffic, aircraft maintenance data and electronic checklists, manuals, and procedures. One or more of the flight displays 20 may also be configured to function as, for example, an engine indicating and crew-alerting system (EICAS) display used to display critical engine and system status data. Other types and functions of the flight displays 20 are contemplated as well. According to various exemplary embodiments of the inventive concepts disclosed herein, at least one of the flight displays 20 may be configured to provide a rendered display from the systems and methods of the inventive concepts disclosed herein.

In some embodiments, the flight displays 20 may provide an output based on data received from a system external to an aircraft, such as a ground-based weather radar system, satellite-based system, a sensor system, or from a system of another aircraft. In some embodiments, the flight displays 20 may provide an output from an onboard aircraft-based weather radar system, LIDAR system, infrared system or other system on an aircraft. For example, the flight displays 20 may include a weather display, a weather radar map, and a terrain display. In some embodiments, the flight displays 20 may provide an output based on a combination of data received from multiple external systems or from at least one external system and an onboard aircraft-based system. The flight displays 20 may include an electronic display or a synthetic vision system (SVS). For example, the flight displays 20 may include a display configured to display a two-dimensional (2-D) image, a three dimensional (3-D) perspective image of terrain and/or weather information, or a four dimensional (4-D) display of weather information or forecast information. Other views of terrain and/or weather information may also be provided (e.g., plan view, horizontal view, vertical view). The views may include monochrome or color graphical representations of the terrain and/or weather information. Graphical representations of weather or terrain may include an indication of altitude of the weather or terrain or the altitude relative to an aircraft. The flight displays 20 may receive image information, such as a visualization generated based on an indication of a runway surface condition, and display the image information.

The UI elements 22 may include, for example, dials, switches, buttons, touch screens, keyboards, a mouse, joysticks, cursor control devices (CCDs), menus on Multi-Functional Displays (MFDs), or other multi-function key pads certified for use with avionics systems. The UI elements 22 may be configured to, for example, allow an aircraft crew member to interact with various avionics applications and perform functions such as data entry, manipulation of navigation maps, and moving among and selecting checklist items. For example, the UI elements 22 may be used to adjust features of the flight displays 20, such as contrast, brightness, width, and length. The UI elements 22 may also (or alternatively) be used by an aircraft crew member to interface with or manipulate the displays of the flight displays 20. For example, the UI elements 22 may be used by aircraft crew members to adjust the brightness, contrast, and information displayed on the flight displays 20. The UI elements 22 may additionally be used to acknowledge or dismiss an indicator provided by the flight displays 20. The UI elements 22 may be used to correct errors on the flight displays 20. The UI elements 22 may also be used to adjust the radar antenna tilt, radar display gain, and to select vertical sweep azimuths. Other UI elements 22, such as indicator lights, displays, display elements, and audio alerting devices, may be configured to warn of potentially threatening conditions such as severe weather, terrain, and obstacles, such as potential collisions with other aircraft.

Figure 2:
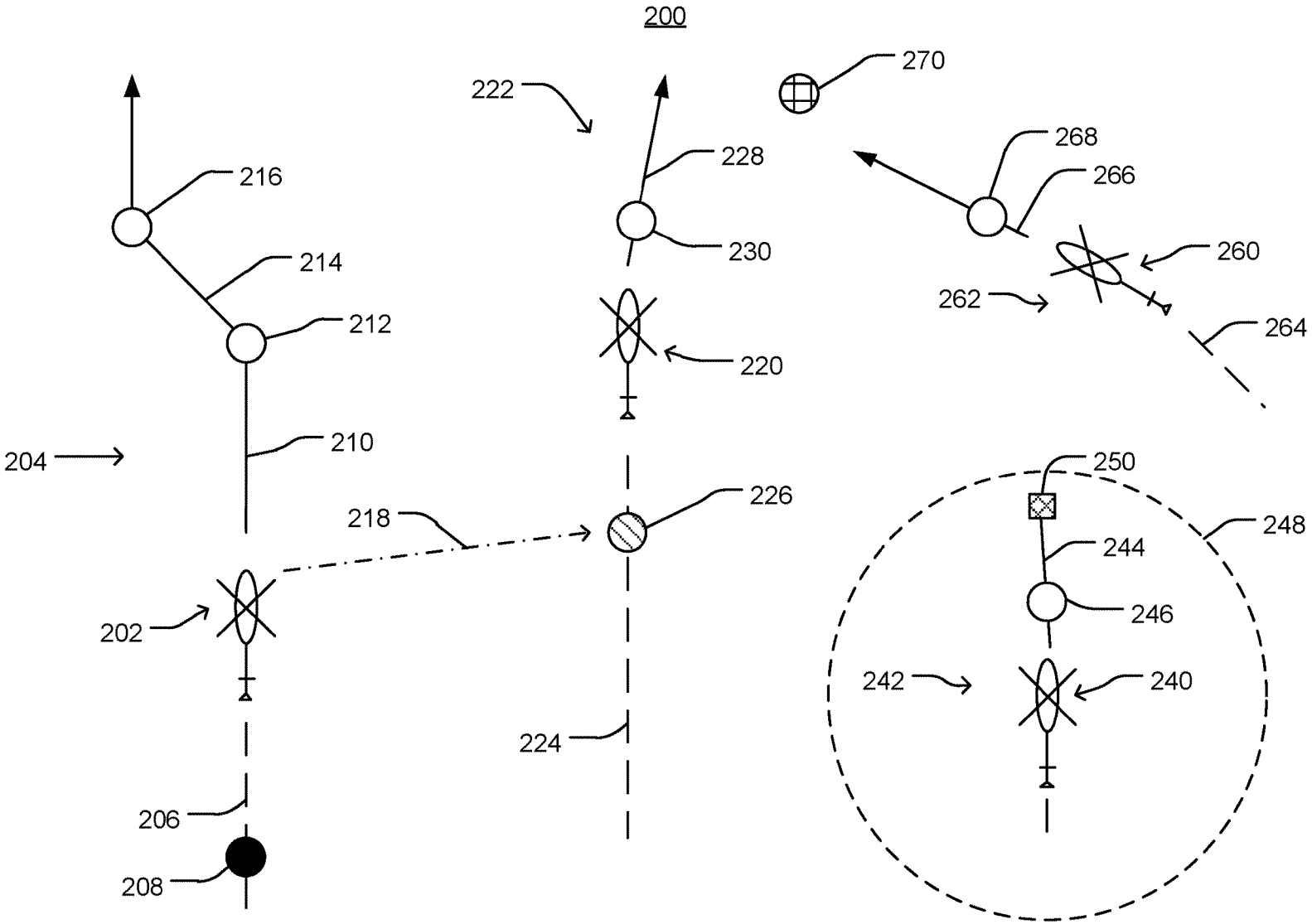
FIG. 2 is a schematic illustration of an exemplary embodiment of a group flight plan according to the inventive concepts disclosed herein.

Referring now to FIG. 2, a group flight plan 200 is shown according to an exemplary embodiment of the inventive concepts disclosed herein. The group flight plan 200 may be displayed on a display (e.g., flight displays 20). The group flight plan 200 may incorporate flight plans from disparate platforms. The group flight plan 200 may be used by various platforms (e.g., fixed wing aircraft, rotary wing aircraft). As compared to existing systems, in which individual platforms are limited to only viewing and interacting with individual flight plans, systems and methods in accordance with the inventive concepts disclosed herein may be able to view and interact with the full group flight plan 200. In some embodiments, the group flight plan 200 integrates flight plans from a plurality of helicopters in a joint task team.

The group flight plan 200 illustrates a first airborne platform 202 associated with a first flight plan 204. The first flight plan 204 includes a first flight portion 206 including a first action 208 (e.g., actionable event). The first action 208 (as well as other actions described herein for respective platform(s)) may include or be associated with at least one of a waypoint or an action to be performed by the first airborne platform 202. The action to be performed may include a load/cargo receive action, a drop off/cargo supply action, a refueling action, a time-based action, an action in a checklist, an action in a sequence of actions (e.g., to be performed after other actions), or other actions performed by platforms as part of a flight plan. The action to be performed may include a radio tuning or adjustment action, or a report generation and transmission action.

Each action may be associated with an action state (e.g., flight action state). The action state may include a complete state, indicating that any requirements of the action have been completed. For example, if the action is to load cargo, the action can have a complete state when the cargo is loaded. If the action is to travel through a waypoint (e.g., travel within a threshold distance of a position, such as a position indicated by longitude and latitude), the action can have a complete state when it is determined that the airborne platform has traveled through the waypoint.

The action state may include a not yet complete state, indicating that at least one requirement of the associated action has not been completed. For example, if the action is to load cargo, the action can have a not yet complete state prior to a determination that the cargo is fully loaded. If the action is to travel through a waypoint, the action can have a not yet complete state prior to a determination that the airborne platform has traveled through the waypoint (which may include a determination that the waypoint may still be reached by the airborne platform). In some embodiments, the not yet complete state is a default state of an action.

The action state may include an incomplete state. For example, if the action is to load cargo, the action can have the incomplete state if it is determined that less than a full amount of the cargo has been loaded.

The action state may include an unassigned state. For example, a command platform or other platform may add an action to the group flight plan, such that other platforms may elect to perform the unassigned action.

The action state may include a cannot be completed state. For example, if the action is to load cargo, but the airborne platform has insufficient cargo space, flight range, or is otherwise unable to complete the action, then the action state may be the cannot be completed state. In some embodiments, the cannot be completed state is a substate of the incomplete state (e.g., if an action cannot be completed, then it may also be incomplete).

As shown in FIG. 2, as indicated by the filled in circle of the first action 208, the first airborne platform has completed the first action 208 (e.g., the first action 208 has a complete state), and as indicated by the dashed line of the first flight portion 206, has traveled past the first flight portion 206.

The first flight plan 204 includes a second flight portion 210 to be traveled by the first airborne platform 202. The second flight portion 210 includes and/or terminates in a second action 212, which, as indicated by the empty circle, has a not yet complete state. The first flight plan 204 also includes a third flight portion 214 to be traveled by the first airborne platform 202. The third flight portion 214 includes and/or terminates in a third action 216, which, as indicated by the empty circle, has a not yet complete state.

The group flight plan 200 illustrates a second airborne platform 220 associated with a second flight plan 222. The second flight plan includes a fourth flight portion 224 including or terminating in a fourth action 226. As indicated by the hatched lines, the fourth action 226 has an incomplete state, as the second airborne platform 220 did not complete the fourth action 226. In some embodiments, the fourth action 226 may additional or alternatively be associated with a cannot be completed state (e.g., the second airborne platform 220 may indicate that the second airborne platform 220 cannot complete the fourth action 226). The second flight plan 222 includes a fifth flight portion 228 including a fifth action 230.

In some embodiments, the group flight plan 200 may include an indication that a platform other than the second airborne platform 220 can proceed to or is proceeding to perform the fourth action 226. For example, as indicated by the sixth flight portion 218 (shown in dash-dot lines), the first airborne platform 202 may be able to perform the fourth action 226, such as by diverting from second flight portion 210 to follow sixth flight portion 218. As will be described further herein, the first airborne platform 202 may be able to update the action state of the fourth action 226 from the incomplete state to a not yet complete state, such as by communicating an updated group flight plan including an indication that the first airborne platform 202 will perform the fourth action 226.

The group flight plan 200 illustrates a third airborne platform 240 associated with a third flight plan 242. The third flight plan 242 includes a seventh flight portion 244 including a seventh action 246 (which is not yet complete) and terminating in a destination 250, indicated by the shaded square. As shown in FIG. 2, the third airborne platform 240 is associated with a flight range 248. Unlike the first airborne platform 202, which may be able to perform the fourth action 226, the third airborne platform 240 cannot perform the fourth action 226 because the fourth action 226 is not within the flight range 248 of the third airborne platform 240.

The group flight plan 200 illustrates a fourth airborne platform 260 associated with a fourth flight plan 262. The fourth flight plan 262 includes an eighth flight portion 264 which has been traveled by the fourth airborne platform 260, and a ninth flight portion 266 including an eight action 268. The group flight plan 200 also includes an unassigned action 270, which the fourth airborne platform 260 may be able to perform.

Figure 3:
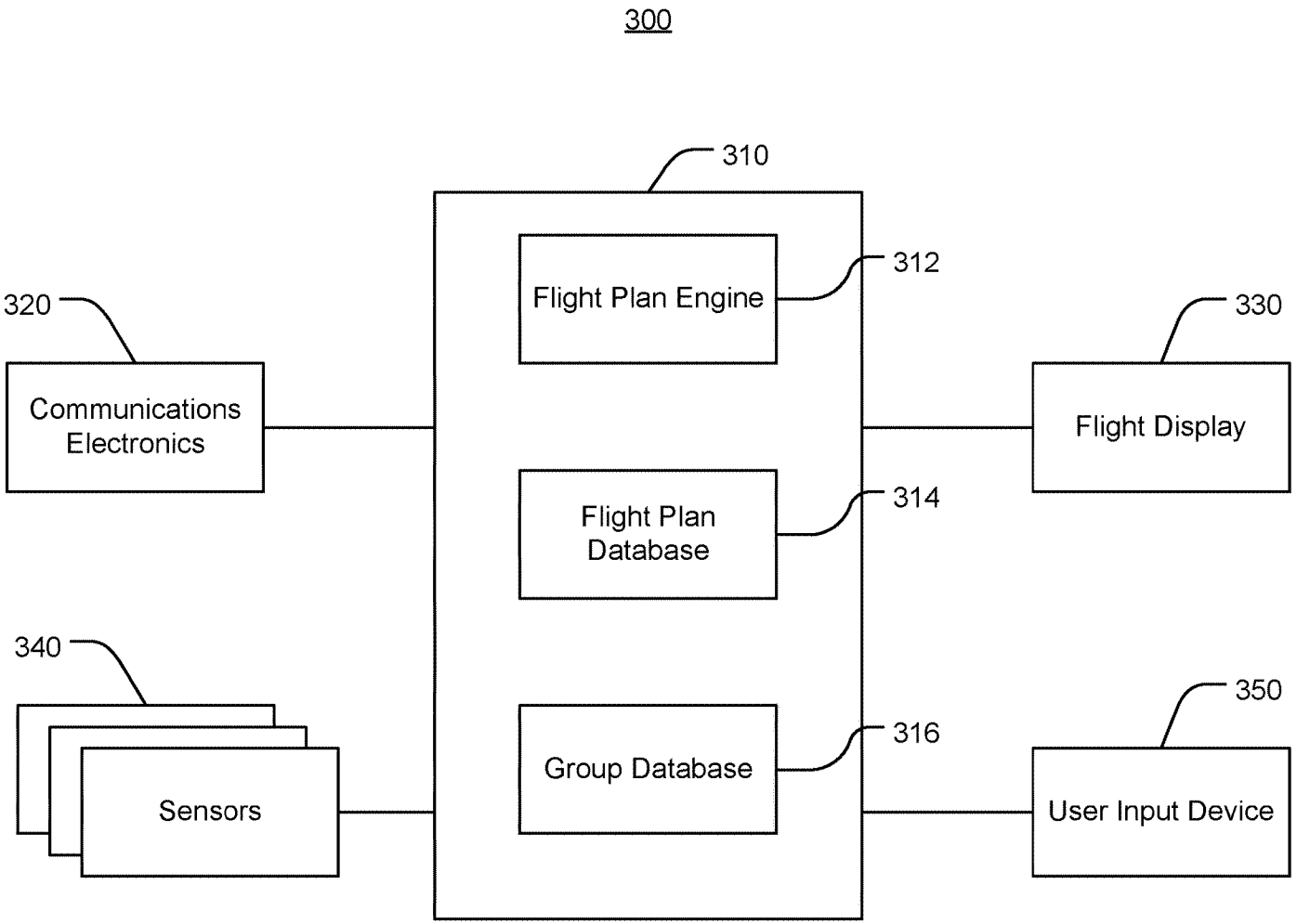
FIG. 3 is a block diagram of an exemplary embodiment of a system for actionable avionics events according to the inventive concepts disclosed herein.

Referring now to FIG. 3, a block diagram of a system 300 is shown according to an exemplary embodiment of the inventive concepts disclosed herein. The system 300 can be implemented on various platforms described herein, including the airborne platforms described with reference to FIG. 2. As will be described herein, the system 300 is implemented on an instant platform, which may be in a group with one or more remote platforms. Briefly, the system 300 includes an avionics circuit 310, communications electronics 320, a flight display 330, one or more sensors 340, and a user input device 350.

The avionics circuit 310 may include processing hardware (e.g., processors and memory devices) configured to execute the functions described herein. For example, the avionics circuit 310 can include a processing circuit, which may include a processor and a memory. The processor may be implemented as a specific purpose processor, an application specific integrated circuit (ASIC), one or more field programmable gate arrays (FPGAs), a group of processing components, or other suitable electronic processing components. The memory is one or more devices (e.g., RAM, ROM, flash memory, hard disk storage) for storing data and computer code for completing and facilitating the various user or client processes, layers, and modules described in the present disclosure. The memory may be or include volatile memory or non-volatile memory and may include database components, object code components, script components, or any other type of information structure for supporting the various activities and information structures of the inventive concepts disclosed herein. The memory is communicably connected to the processor and includes computer code or instruction modules for executing one or more processes described herein. The memory can include various circuits, software engines, and/or modules that cause the processor to execute the systems and methods described herein. The avionics circuit 310 can be used by various platforms to execute the functions performed by the platforms of FIG. 2.

The communications electronics 320 are configured to receive and transmit data. The communications electronics 320 can include receiver electronics and transmitter electronics. The communications electronics 320 can include a radio configured for radio frequency communication. The communications electronics 320 can include a datalink radio. The communications electronics 320 can enable the flight plan engine 312 to receive and transmit flight plans from/to remote platforms. The communications electronics 320 can be configured to establish a secure communications link to a remote platform to facilitate secure communication of flight plans and actions thereof.

The flight display 330 can incorporate features of the flight displays 20 described with reference to FIG. 1. The flight display 330 can be configured to display a local flight plan (e.g., a flight plan stored in the flight plan database 314 of the avionics circuit 310). The flight display 330 can be configured to display a group flight plan (e.g., a group flight plan stored in the flight plan database 314 and/or received from a remote platform via the communications electronics 320). The user input device can incorporate features of the UI elements described with reference to FIG. 1, such as for receiving touch inputs or other inputs for controlling the flight display 330 and/or updating flight plans displayed by the flight display 330.

The avionics circuit 310 includes a flight plan engine 312 and a flight plan database 314. The flight plan database 314 is configured to store a local flight plan. The local flight plan can include one or more flight actions associated with a plan event condition. The plan event condition can include at least one of a time, a waypoint, or a position. The plan event condition can include a receipt (e.g., loading) or a deposit (e.g., drop-off) of cargo or personnel. The plan event condition can be associated with a refueling (e.g., receiving fuel at the instant platform or transferring fuel to a remote platform).

The flight plan engine 312 is configured to generate a group flight plan. The group flight plan can be transmitted to one or more remote platforms, which can enable a group of platforms to manage, collaborate, and share each other's flight plan actions in real time.

In some embodiments, while the instant platform is executing a flight plan (e.g., while the instant platform is in flight, is landing, is taking off, or is otherwise in an operational state), the flight plan engine 312 is configured to compare the plan event condition of at least one flight action of the local flight plan to a current event condition. The flight plan engine 312 can determine an action state of the at least one flight action based on the comparison.

In some embodiments, the current event condition is associated with a time. For example, the flight plan engine 312 can be configured to retrieve the current event condition as a time from a clock of the instant platform. The flight plan engine 312 can compare the retrieved time to a time of the plan event condition, such as a time by which the local flight plan indicates the at least one flight action is to be completed. The flight plan engine 312 can determine the action state based on the comparison; for example, if the retrieved time is before or at the same time as the time of the plan event condition, the flight plan engine 312 can determine the action state to be the complete state. In some embodiments, the plan event condition includes a threshold amount of time in which the plan event condition can be satisfied (e.g., the action must be completed within the threshold amount of time of the indicated time).

The current event condition may be associated with a position, such as a longitude-latitude pair position. The position may also include an altitude component. The flight plan engine 312 can be configured to retrieve the current event condition as a position from a position sensor (e.g., a GPS sensor of the one or more sensors 340). The flight plan engine 312 can compare the retrieved position to a position of the plan event condition, such as a waypoint position. The flight plan engine 312 can determine the action state based on the comparison; for example, if the retrieved position is equal to or within a threshold distance of the position of the plan event condition, then the flight plan engine 312 can determine the action state to be the complete state.

The flight plan engine 312 can be configured to determine the current event condition based on a user input, in some embodiments. The flight plan engine 312 can receive the user input as an input indicating the action state of the at least one flight action (e.g., complete, not yet complete, incomplete, cannot be completed). The flight plan engine 312 can receive the user input as an input indicating a parameter associated with the flight action (e.g., amount of cargo loaded).

In some embodiments, one or more flight actions may be associated with a plurality of plan event conditions. For example, the flight action may be associated with a plan event condition for the action to be completed by a specific time and at a specific location. The plan event condition may be for the action to be completed at a specific location and to retrieve a specific cargo. Other combinations of plan event conditions may also be associated with the flight action.

As discussed above with reference to FIG. 2, the action state may also be a not yet complete state, an incomplete state, or a cannot be completed state. If the plan event condition is a time-based condition, the flight plan engine 312 can determine the action state to be the cannot be completed state if the retrieved current time has passed the time of the plan event condition. The flight plan engine 312 can determine the action state to be the incomplete state if the retrieved current time is before the time of the plan event condition, and a corresponding position of the flight action is within a flight range of the instant platform. Similarly, the flight plan engine 312 can determine the action state to be the cannot be completed state if the position of the flight action is not within the flight range (even if the retrieved current time is before the time of the plan event condition).

In some embodiments, the flight plan engine 312 determines the action state based on a priority associated with one or more flight actions of the flight plan. For example, a first action may have a high or mandatory priority, while a second action may have a low or optional priority. The flight plan engine 312 can modify the second action from a not yet completed state to a cannot be completed state based on the low or optional priority, such as to ensure that the first action is performed. For example, the flight plan engine 312 can calculate an expected flight range of the instant platform (e.g., based on a fuel level of the instant platform and a fuel burn rate algorithm representing a relationship between speed and fuel burn), based on the expected flight range, determine whether one or both of the first action and the second action can be completed, and if both the first action and second action can be completed, determine the action state of both the first action and the second action to be the incomplete state, while if only the first action can be completed, determine the action state of the first action to be the incomplete state and the second action to be the cannot be completed state.

The flight plan engine 312 can generate a group flight plan which includes the at least one action based on the determined action state. The group flight plan can include one or more of the flight actions of the local flight plan. The group flight plan can associate action states and plan event conditions with each action.

The flight plan engine 312 can transmit the group flight plan to one or more remote platforms. The flight plan engine 312 can transmit the group flight plan on an intermittent basis. The flight plan engine 312 can transmit the group flight plan in response to receiving a transmit command via the user input device 350 or from a remote platform requesting the group flight plan. The flight plan engine 312 can transmit the group flight plan in response to detecting a change in an action state of one or more flight actions (e.g., based on receiving a command from the user input device 350 to change the action state). The flight plan engine 312 can transmit the group flight plan in response to determining the action state to be the incomplete state, which can enable remote platforms, in real time, to gain situational awareness regarding the flight action and/or take on the flight action. The flight plan engine 312 can transmit the group flight plan with instructions for a selected remote platform to execute a particular flight action, such that the flight plan engine 312 can assign flight actions to the selected remote platform.

In some embodiments, the avionics circuit 310 includes a group database 316. The group database can include communications information (e.g., communications protocols) for communication with one or more remote platforms corresponding to appropriate communications information. The flight plan engine 312 can be configured to transmit the group flight plan based on the communication information. For example, the flight plan engine 312 can identify the one or more remote platforms for transmission of the group flight plan, retrieve corresponding communications information for the identified remote platform(s), and transmit the group flight plan using the retrieved communications information. In some embodiments, the group database 316 includes communication information associated with a private network or tactical network implementation, such that the flight plan engine 312 can selectively transmit the group flight plan to those remote platforms which are part of the private network or tactical network.

The group database 316 may store parameter data regarding the one or more remote platforms. For example, the group database 316 may store energy state data such as known (or most recently received) position or heading data. The flight plan engine 312 can be configured to request the energy state data from the one or more remote platforms and update the group database 316 based on the requested energy state data, or to parse a remote group flight plan as described below to identify the energy state data. Similarly, the group database 316 can be configured to store parameter data such as cargo capacity, flight range, cruising speed, origin, destination, flight plan actions, or other parameters associated with remote platforms. The flight plan engine 312 can be configured to generate the group flight plan based on the parameter data in order to conform the group flight plan to the one or more remote platforms. The flight plan engine 312 can be configured to selectively transmit the group flight plan to one or more particular remote platforms based on the parameter data, such as to provide remote platforms with flight plan information specific to flight actions which can or should be performed by the particular remote platform(s).

In some embodiments, the local flight plan is associated with a first communication protocol, the communication information includes a second communication protocol different than the first communication protocol, and the flight plan engine 312 is configured to generate the group flight plan based on the second communication protocol. For example, the communications protocols may include different data formats, and the flight plan engine 312 can be configured to convert the flight actions of the local flight plan to flight actions of the group flight action by executing a format conversion algorithm. The flight plan engine 312 may be configured to generate the group flight plan to selectively include flight actions from the local flight plan which can be converted (e.g., in terms of format) from the first communication protocol to the second communication protocol. The flight plan engine 312 can be configured to select the one or more remote platforms for transmission of the group flight plan based on at least one of a position, a heading, a range, or a load capacity of the one or more remote platforms, which can enable flight actions to be selectively shared with remote platforms capable of performing the flight actions.

In some embodiments, the flight plan engine 312 can receive a remote group flight plan from a remote platform. The flight plan engine 312 can parse the remote group flight plan to identify one or more remote flight actions of the remote group flight plan. Similar to other flight plans described herein, the one or more remote flight actions can be associated with plan event conditions and/or action states.

In some embodiments, the flight plan engine 312 is configured to request the group flight plan from one or more remote platforms. For example, the flight plan engine 312 can request the group flight plan on a regular basis (e.g., at intermittent intervals). The flight plan engine 312 can request the group flight plan in response to a request command (e.g., a request command received from user input device 350.

The flight plan engine 312 can be configured to update a display of the local flight plan on the flight display 330 based on the received remote group flight plan. For example, the flight plan engine 312 can update the display of the local flight plan using the one or more remote flight actions. Updating the display may include adding remote flight actions as well as changing an action state of local and/or remote flight actions based on the information in the group flight plan. For example, the flight plan engine 312 can compare an identifier of a local flight action of the local flight plan to an identifier of a remote flight action of the group flight plan to determine if the remote flight action matches the local flight action. In response to determining that the remote flight action matches the local flight action, the flight plan engine 312 can compare the action state of the remote flight action to the action state of the local flight action, and update the action state of the local flight action to match the action state of the remote flight action.

In some embodiments, the flight plan engine 312 is configured execute processing actions based on acceptance criteria (e.g., rules, policies, heuristics) associated with each remote flight action. For example, the flight plan engine 312 can update the display of the local flight plan on the flight display 330 based on acceptance criteria. As noted above, updating the display of the local flight plan can include adding remote flight actions (e.g., if the remote flight action satisfies the acceptance criteria) or changing an action state of local and/or remote flight actions (e.g., changing the action state if the remote flight action satisfies the acceptance criteria). In various such embodiments, by using the acceptance criteria, the flight plan engine 312 can improve situational awareness for a pilot or other operator of the instant platform by intelligently and selectively updating the local flight plan to display remote flight actions being performed or to be performed by remote platforms, enabling the operator to make better decisions regarding various actions. Additionally or alternatively to updating the display of the local flight plan based on the remote group flight plan and/or acceptance criteria, the flight plan engine 312 can rewrite the local flight plan stored in the flight plan database 314 or write the remote group flight plan into the group database 316 based on the remote group flight plan and/or acceptance criteria.

The acceptance criteria may include a position of the instant platform. For example, the flight plan engine 312 can compare a position of the instant platform to a position of the remote flight action to determine an action distance, and update the local flight plan to display the remote flight action if the action distance is less than an action distance threshold. The action distance threshold may be a function of a range (e.g., flight range) of the instant platform, so that the flight plan engine 312 can selectively update the local flight plan to include those remote flight actions which are within the flight range of the instant platform. The action distance threshold may be a function of a display dimension of the flight display 330 (e.g., given a relationship between distance and a number of pixels of the flight display 330 which defines a visual range of the flight display 330, update the local flight plan with the remote flight action if the remote flight action is in the visual range of the flight display 330). The acceptance criteria may also include the range of the instant platform.

The acceptance criteria may include a heading of the instant platform. For example, the flight plan engine 312 can compare a heading of the instant platform to a modified heading from a current position of the instant platform to a position of the remote flight action, and if a difference (e.g., absolute value difference) between the heading of the instant platform and the modified heading is less than a heading difference threshold, then the flight plan engine 312 can update the local flight plan using the remote flight action.

The acceptance criteria may include a load capacity of the instant platform. For example, the flight plan engine 312 can determine that the remote flight action is a load-based action, retrieve a load size associated with the remote flight action from the group flight plan, compare the load size to the load capacity, and update the local flight plan based on a load difference between the load size and the load capacity. Updating the local flight plan may include updating the local flight plan to display the remote flight action if the load size is less than the load capacity. Updating the local flight plan may include updating the local flight plan to display the remote flight action with an indication of whether the load size is less than or greater than the load capacity.

The acceptance criteria may include a cargo (e.g., onboard cargo) of the instant platform. For example, the flight plan engine 312 can retrieve a cargo demand of the remote flight action from the group flight plan, compare the cargo demand to the cargo of the instant platform, and update the local flight plan if the cargo demand matches the cargo of the instant platform.

In some embodiments, the acceptance criteria includes a command request. For example, the flight plan engine 312 can be configured to receive a command request to perform a commanded flight action via the communications electronics 320. The command request may include the command flight action and instructions configured to cause the flight plan engine 312 to update the display of the local flight plan. The flight plan engine 312 can automatically update the display of the local flight plan to include the at least one remote flight action in response to receive the command request. The command request may be received from a command platform (e.g., a ground commander).

The flight plan engine 312 can be configured to filter actions of the local flight plan displayed based on the flight actions and/or acceptance criteria. For example, the flight plan engine 312 can be configured to selectively display time-sensitive actions, such as actions for which a required time for completion is within a threshold time of a current time. The flight plan engine 312 can be configured to selectively display actions associated with specific waypoints.

Figure 4:
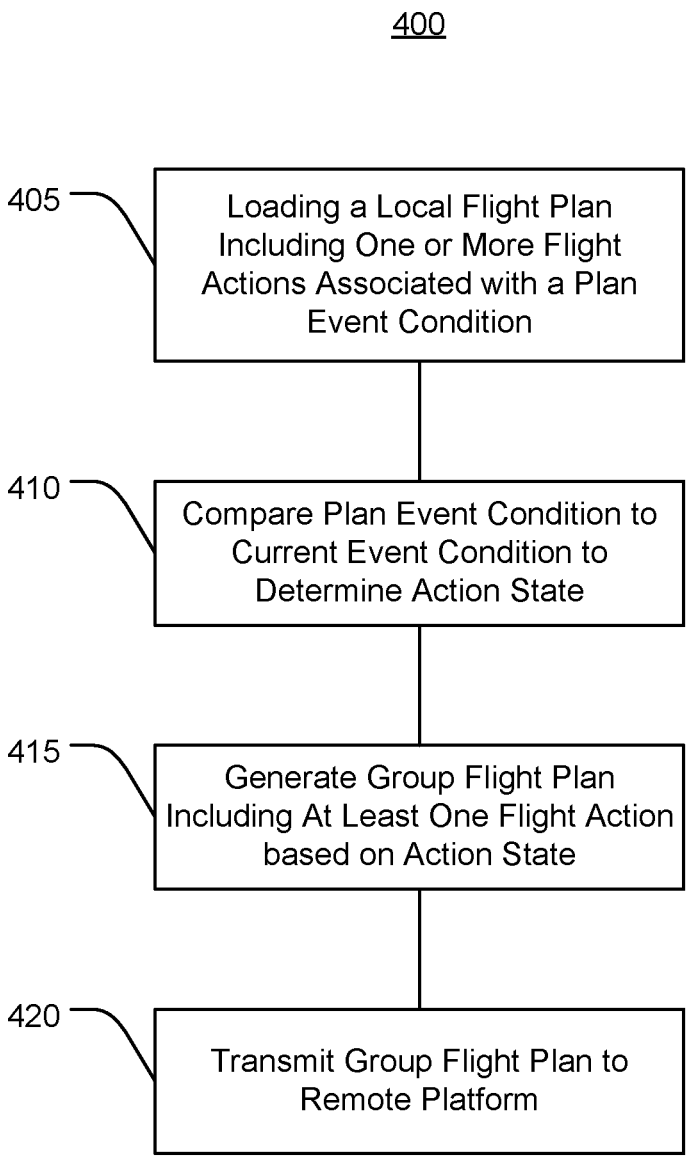
FIG. 4 is a flow chart of an exemplary embodiment of a method for communicating actionable avionics events according to the inventive concepts disclosed herein.

Referring to FIG. 4, an exemplary embodiment of a method 400 accordingly to the inventive concepts disclosed herein may include the following steps. The method 400 may be performed using various hardware, apparatuses, and systems disclosed herein, such as the aircraft control center 10, the group flight plan 200, the system 300, and or/components thereof.

A step (405) may include loading a local flight plan including one or more flight actions associated with a plan event condition. The plan event condition may include at least one of a time, a waypoint, or a position. The plan event condition can include a receipt (e.g., loading) or a deposit (e.g., drop-off) of cargo or personnel. The plan event condition can be associated with a refueling (e.g., receiving fuel at the instant platform or transferring fuel to a remote platform).

A step (410) may include comparing the plan event condition of at least one flight action to a current event condition. The comparing may be executed while a platform is in an operational state, such as when an airborne platform is taking off, in flight, or landing. The current event condition may be associated with a time, position, waypoint, and/or user input. The flight plan engine 312 can determine an action state of the at least one flight action based on the comparison. The action state may be a complete state, a not yet complete state, an incomplete state, or a cannot be completed state. In some embodiments, the action state is determined based on a priority associated with one or more of the flight actions.

A step (415) may include generating a group flight plan including the at least one flight action based on the action state. The group flight plan can include one or more of the flight actions of the local flight plan. The group flight plan can associate action states and plan event conditions with each action.

A step (420) may include transmitting the group flight plan to one or more remote platforms. The group flight plan may be transmitted on an intermittent basis, in response to receiving a transmit command, or in response to detecting a change in an action state. The group flight plan can be transmitted in response to determining the action state to be the incomplete state, which can enable remote platforms, in real time, to gain situational awareness regarding the flight action and/or take on the flight action.

As will be appreciated from the above, systems and methods for actionable avionics events according to embodiments of the inventive concepts disclosed herein may improve operation of aircraft and other platforms by increasing situational awareness for each platform. For example, embodiments of the inventive concepts disclosed herein can improve situational awareness for pilots or other operators of the platforms by enabling real-time displaying of the actions in flight plans of remote platforms, including whether such actions have been completed, are not yet completed, are incomplete, or cannot be completed, reducing the amount of information operators need to keep in mind to effectively control operation of platforms. Systems manufactured in accordance with the inventive concepts disclosed herein can also improve operation of heterogeneous platform communication networks by enabling real-time sharing of flight plans using existing communication links.

It is to be understood that embodiments of the methods according to the inventive concepts disclosed herein may include one or more of the steps described herein. Further, such steps may be carried out in any desired order and two or more of the steps may be carried out simultaneously with one another. Two or more of the steps disclosed herein may be combined in a single step, and in some embodiments, one or more of the steps may be carried out as two or more sub-steps. Further, other steps or sub-steps may be carried out in addition to, or as substitutes to one or more of the steps disclosed herein.

From the above description, it is clear that the inventive concepts disclosed herein are well adapted to carry out the objects and to attain the advantages mentioned herein as well as those inherent in the inventive concepts disclosed herein. While presently preferred embodiments of the inventive concepts disclosed herein have been described for purposes of this disclosure, it will be understood that numerous changes may be made which will readily suggest themselves to those skilled in the art and which are accomplished within the broad scope and coverage of the inventive concepts disclosed and claimed herein.

What is claimed is:

1. A system, comprising:

a flight plan database configured to store a local flight plan, the local flight plan including one or more flight actions associated with a plan event condition including at least one of a time, a waypoint, or a position; and a flight plan engine configured to:

while a platform is in an operational state, compare the plan event condition of at least one flight action to a current event condition to determine an action state of the at least one flight action;

generate a group flight plan including the at least one action based on the action state;

transmit the group flight plan to one or more remote platforms;

receive a remote group flight plan from a remote platform;

identify one or more remote flight actions of the remote platform; and update a display of the local flight plan on a flight display to include the one or more remote flight actions based on the one or more remote flight actions satisfying an acceptance criteria.

2. The system of claim 1, wherein the acceptance criteria is based on at least one of the position, a heading, a range, or a load capacity of the platform.

3. The system of claim 1, wherein the acceptance criteria includes a command request, and at least one remote flight action of the remote group flight plan includes a command configured to satisfy the command request to cause the flight plan engine to automatically update the display of the local flight plan to include the at least one remote flight action.

4. The system of claim 1, further comprising a group database comprising communication information for communicating with corresponding one or more remote platforms, wherein the flight plan engine is further configured to transmit the group flight plan based on the communication information.

5. The system of claim 4, wherein the local flight plan is associated with a first communication protocol, the communication information includes a second communication protocol different than the first communication protocol, and the flight plan engine is configured to generate the group flight plan based on the second communication protocol.

6. The system of claim 1, wherein the flight plan engine is configured to determine the current event condition based on a user input.

7. The system of claim 1, wherein the flight plan engine is configured to retrieve the current event condition from a clock of the platform if the plan event condition includes the time, and from a position sensor of the platform if the plan event condition includes at least one of the waypoint or the position.

8. The system of claim 1, wherein the action state includes a not yet complete state, a complete state, an incomplete state, or a cannot be completed state, and the flight plan engine is configured to transmit the group flight plan to the one or more remote platforms in response to determining the action state to be the incomplete state.

9. The system of claim 1, wherein the flight plan engine is configured to select the one or more remote platforms for transmission of the group flight plan based on at least one of the position, a heading, a range, or a load capacity of the one or more remote platforms.

10. The system of claim 1, wherein the operational state includes at least one of taking off, landing, being in flight, or executing the local flight plan.

11. A method, comprising:

loading a local flight plan including one or more flight actions associated with a plan event condition including at least one of a time, a waypoint, or a position;

while an airborne platform is in flight, comparing the plan event condition of at least one flight action to a current event condition to determine an action state of the at least one flight action;

generating a group flight plan including the at least one flight action based on the action state;

transmitting the group flight plan to one or more remote platforms;

receiving a remote group flight plan from a remote platform;

identifying one or more remote flight actions of the remote group flight plan; and updating a display of the local flight plan on a flight display to include the one or more remote flight actions based on the one or more remote flight actions satisfying an acceptance criteria.

12. The method of claim 10, wherein the acceptance criteria is based on at least one of the position, a heading, a range, or a load capacity of the airborne platform.

13. The method of claim 11, further comprising transmitting the group flight plan to the one or more remote platforms based on communication information corresponding to the one or more remote platforms.

14. The method of claim 11, further comprising determining the action state of the at least one flight action to be one of a not yet complete state, a complete state, an incomplete state, or a cannot be completed state, and transmitting the group flight plan to the one or more remote platforms in response to determining the action state to be the incomplete state.

* * * * *